US006725011B2

(12) United States Patent
Sato

(10) Patent No.: US 6,725,011 B2
(45) Date of Patent: Apr. 20, 2004

(54) IMAGE FORMING APPARATUS PROVIDED WITH A REVERSE DISCHARGING PORTION

(75) Inventor: Akihiro Sato, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 83 days.

(21) Appl. No.: 10/119,706

(22) Filed: Apr. 11, 2002

(65) Prior Publication Data

US 2002/0159805 A1 Oct. 31, 2002

(30) Foreign Application Priority Data

Apr. 12, 2001 (JP) ..... 2001-114654

(51) Int. Cl.[7] ..... G03G 15/00

(52) U.S. Cl. ..... 399/405

(58) Field of Search ..... 399/401, 405, 399/407; 271/184, 186, 188, 288, 298, 301, 303, 305, 291

(56) References Cited

U.S. PATENT DOCUMENTS 5,202,736 A * 4/1993 Komurasaki ..... 399/405
5,418,606 A * 5/1995 Kikuchi et al. ..... 399/405 X
5,852,764 A * 12/1998 Kida et al. ..... 399/401

FOREIGN PATENT DOCUMENTS

JP 8-48447 2/1996

* cited by examiner

*Primary Examiner*—Hoan Tran
(74) *Attorney, Agent, or Firm*—Fitzpatrick, Cella, Harper & Scinto

(57) ABSTRACT

To provide an image forming apparatus capable of discharging sheets without involving any change in page order without having to provide a sheet reversing path anew. An image forming apparatus is provided, in which an image is formed on a sheet by an image forming portion and the sheet is discharged, the apparatus including a main body portion, a first discharging unit capable of normal and reverse rotation and adapted to discharge the sheet with the image formed thereon to a first discharging portion provided on one side of the main body portion, a second discharging unit adapted to discharge the sheet with the image formed thereon to a second discharging portion provided on the other side of the main body portion, a first sheet conveyance route for conveying the sheet with the image formed thereon toward the first discharging unit, and a second sheet conveyance route for conveying the sheet with the image formed thereon toward the second discharging unit, in which a sheet discharging direction control unit is provided, which, when discharging the sheet to the second discharging portion, causes the sheet with the image formed thereon to be conveyed toward the first sheet conveyance route, and then reverses the first discharging unit to convey the sheet toward the second sheet conveyance route.

14 Claims, 18 Drawing Sheets

IMAGE FORMING APPARATUS PROVIDED WITH A REVERSE DISCHARGING PORTION

BACKGROUND OF THE INVENTION

1. Field of the Invention

The present invention relates to an image forming apparatus and, in particular, to a construction for discharging sheets with images formed thereon.

2. Related Background Art

In a conventional image forming apparatus, such as a copying machine or a printer, a sheet on which an image has been formed is discharged onto a sheet discharging portion. When discharging a sheet with an image formed thereon with the front and rear surfaces of the sheet reversed, the sheet is reversed by a sheet reversing path before being discharged. This sheet reversing path is also used when performing two-sided printing.

FIG. 15 shows an example of a conventional image forming apparatus having such a sheet reversing path. In this image forming apparatus, a sheet with an image formed thereon is discharged in the direction of the arrow K by discharging rollers 161. When discharging a sheet after reversing it, a flapper 162 is switched and the sheet with an image formed on the front surface (first surface) thereof is conveyed to a reversing path 167. Then, reversing rollers 165 are rotated in the reverse direction, and the flapper 162 is restored to the original position.

When forming images on both sides of a sheet, the sheet S1 with an image formed on the front surface (first surface) thereof is conveyed to the reversing path 167 by way of a conveying roller pair 166 by switching the flapper 162. Thereafter, when the trailing edge of the sheet passes a flapper 164 provided in the reversing path 167, the reversing rollers 165 are rotated in the reverse direction, and the flapper 164 is switched, whereby the sheet is fed to an intermediate tray 168. In this image forming apparatus constructed as described above, the sheet reversing path 167 is arranged perpendicular to the sheet discharging direction.

FIG. 16 shows another example of a conventional image forming apparatus having a sheet reversing path. In this image forming apparatus, the sheet on which image formation has been effected is discharged not to the side of the apparatus main body but to the interior of the apparatus main body.

In this type of image forming apparatus, a sheet contained in a sheet feeding cassette 21 or an option sheet feeding cassette 103 provided as an option is conveyed to an image forming portion 1 by a sheet feeding portion 2 and a toner image is transferred thereto by an electrophotographic process means 150. Thereafter, the toner image is fixed by a fixing apparatus 151, and the sheet is conveyed to a sheet discharging portion 4.

FIG. 17 shows the construction of the sheet discharging portion 4. As shown in the drawing, this image forming apparatus is equipped with two sheet discharging trays 41 and 42. The sheet to which the toner image has been fixed is discharged onto the first sheet discharging tray 41 by a first discharging roller 51, or onto the second sheet discharging tray 42 situated above the first sheet discharging tray 41 by a second discharging roller 52.

This image forming apparatus is capable of two-sided printing. When performing two-sided printing, a part of the sheet which has passed the fixing apparatus 151 is temporarily discharged onto the first sheet discharging tray 41 by a longitudinal path roller 57 and the first discharging roller 51. Thereafter, when the trailing edge of the sheet has passed a first flapper 58, the longitudinal path roller 57 and the first discharging roller 51 are rotated in the reverse direction to convey the sheet to a two-sided path 152. In this case, the sheet reversing path is the same as the sheet conveying path. Further, the sheet reversing path is perpendicular to the direction of the arrow A in which the sheet is discharged.

Note that the image forming apparatus shown in this drawing functions as both a copying machine and a facsimile apparatus; it is a so-called digital multifunction printer which forms an image by converting the read image information (optical signal) of the original into an electric signal.

In the case of such a multifunction printer, the sheets discharged onto the first and second sheet discharging trays 41 and 42 are rather poor in visibility. Further, it is sometimes required that a sheet conveyed by, for example, a facsimile apparatus should be separately stored. Thus, as shown in FIG. 18, for example, a third sheet discharging tray 43 is detachably provided on the outer side surface of the apparatus main body, and the sheet is discharged onto this third sheet discharging tray 43 by a third sheet discharging roller 53.

When the third sheet discharging tray 43 is thus provided, the sheet to which the toner image has been fixed is discharged onto a third sheet discharging tray 43 by the longitudinal path rollers 54 and 57 and the third discharging roller 53, with the transfer side being directed upwards.

However, when thus discharging the sheet onto the third sheet discharging tray 43, the sheet is discharged with the transfer side being directed upwards, so that when the sheet which has been conveyed up to the longitudinal path roller 54 is conveyed as it is toward the third discharging roller, the page order is reversed.

To avoid reversal in page order, it is necessary to provide a reversing path anew, which leads to an increase in apparatus size. Further, since reversing rollers, etc. have to be provided in the reversing path, an increase in cost and a rather complicated structure are involved.

SUMMARY OF THE INVENTION

The present invention has been made with a view toward solving the above problem. It is an object of the present invention to provide an image forming apparatus capable of discharging sheets without involving any change in page order without having to provide a sheet reversing path anew.

The present invention relates to an image forming apparatus in which an image is formed on sheet by an image forming portion and the sheet is discharged, comprising a main body portion, first discharging means capable of normal and reverse rotation and adapted to discharge the sheet with the image formed thereon to a first discharging portion provided on one side of the main body portion, second discharging means adapted to discharge the sheet with the image formed thereon to a second discharging portion provided on the other side of the main body portion, a first sheet conveyance route for conveying the sheet with the image formed thereon toward the first discharging means, and a second sheet conveyance route for conveying the sheet with the image formed thereon toward the second discharging means, the apparatus being characterized in that sheet discharging direction control means is provided, which, when discharging the sheet to the second discharging portion, causes the sheet with the image formed thereon to be conveyed toward the first sheet conveyance route, and then reverses the first discharging means to convey the sheet toward the second sheet conveyance route.

Also, according to the present invention, an image forming apparatus is characterized in that the sheet discharging direction control means has conveyance route switching means which can be displaced to a first position for conveying the sheet with the image formed thereon toward the first sheet conveyance route and a second position for conveying the sheet conveyed by the first discharging means adapted to be reversed after conveying the sheet toward the first sheet conveyance route, toward the second sheet conveyance route.

Also, according to the present invention, an image forming apparatus is characterized in that the conveyance route switching means is held at the second position by a biasing member and adapted to be displaced to the first position by being pressed by the sheet.

Also, according to the present invention, an image forming apparatus is characterized in that the first discharging portion is a predetermined discharging portion of a plurality of discharging portions provided on one side of the main body portion.

Also, according to the present invention, an image forming apparatus is characterized in that the apparatus main body is provided with a sheet discharging space which is open sidewise, the plurality of discharging portions being provided in the sheet discharging space.

Also, according to the present invention, an image forming apparatus is characterized in that the second discharging portion is detachably provided on an outer side surface of the apparatus main body at a position opposite to the sheet discharging space.

Also, according to the present invention, an image forming apparatus is characterized in that the second discharging portion is a post-processing device for performing post-processing on sheets.

Further, according to the present invention, the sheet discharging direction control means comprises a main body portion, first discharging means capable of normal and reverse rotation and adapted to discharge a sheet with an image formed thereon onto a first discharging portion provided on one side of the main body portion, second discharging means adapted to discharge a sheet with an image formed thereon onto a second discharging portion provided on the other side of the main body portion, a first sheet conveyance route for conveying a sheet with an image formed thereon toward the first discharging means, and a second sheet conveyance route for conveying a sheet with an image formed thereon toward the second discharging means. Then, when discharging a sheet onto the second discharging portion, the sheet with an image formed thereon is conveyed toward the first sheet conveyance route, and then the first discharging means is reversed before conveying the sheet toward the second sheet conveyance route.

DESCRIPTION OF THE PREFERRED EMBODIMENTS

Embodiments of the present invention will now be described in detail with reference to the drawings.

Figure 1:
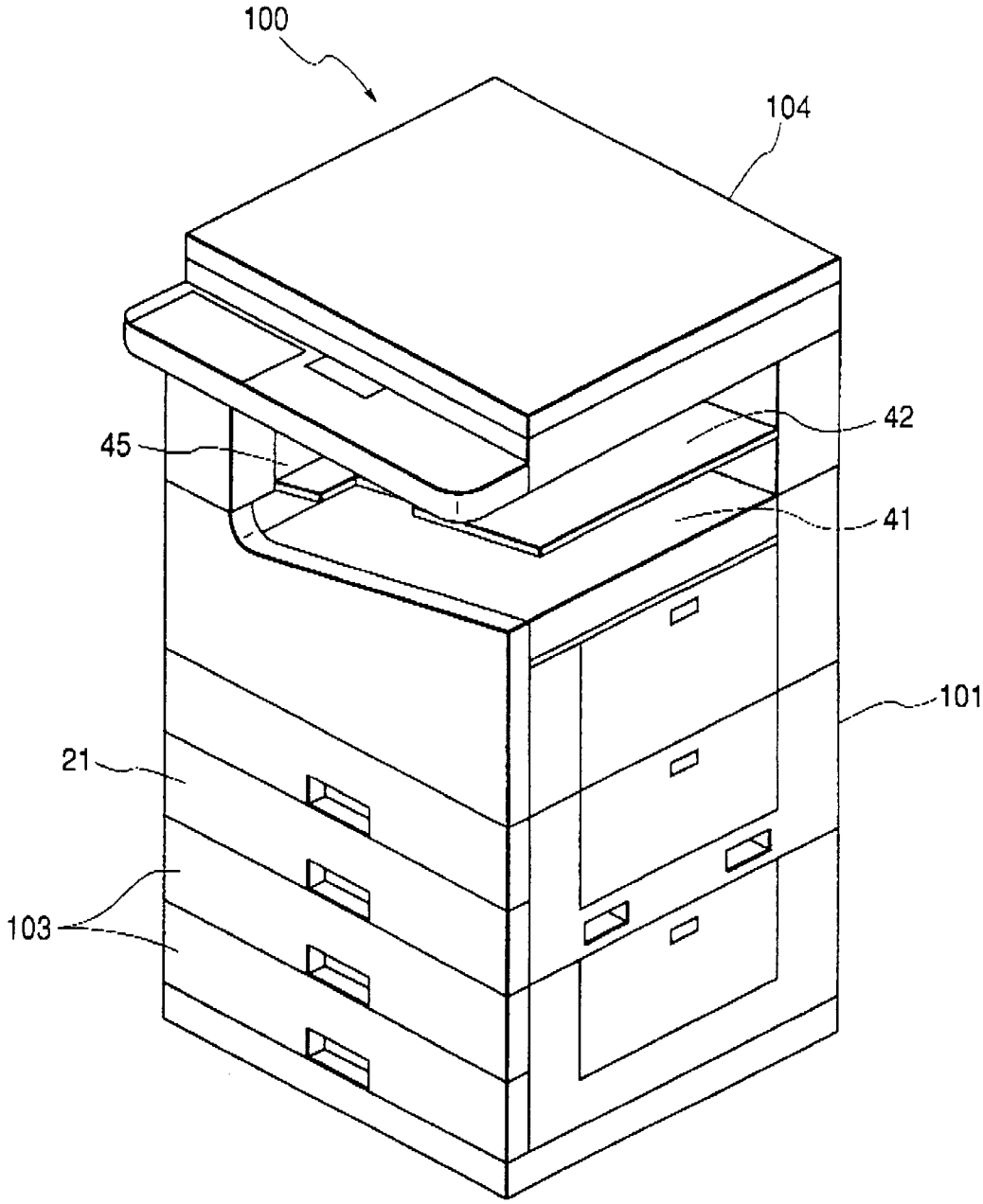
FIG. 1 is a perspective view of an image forming apparatus according to an embodiment of the present invention.
Figure 2:
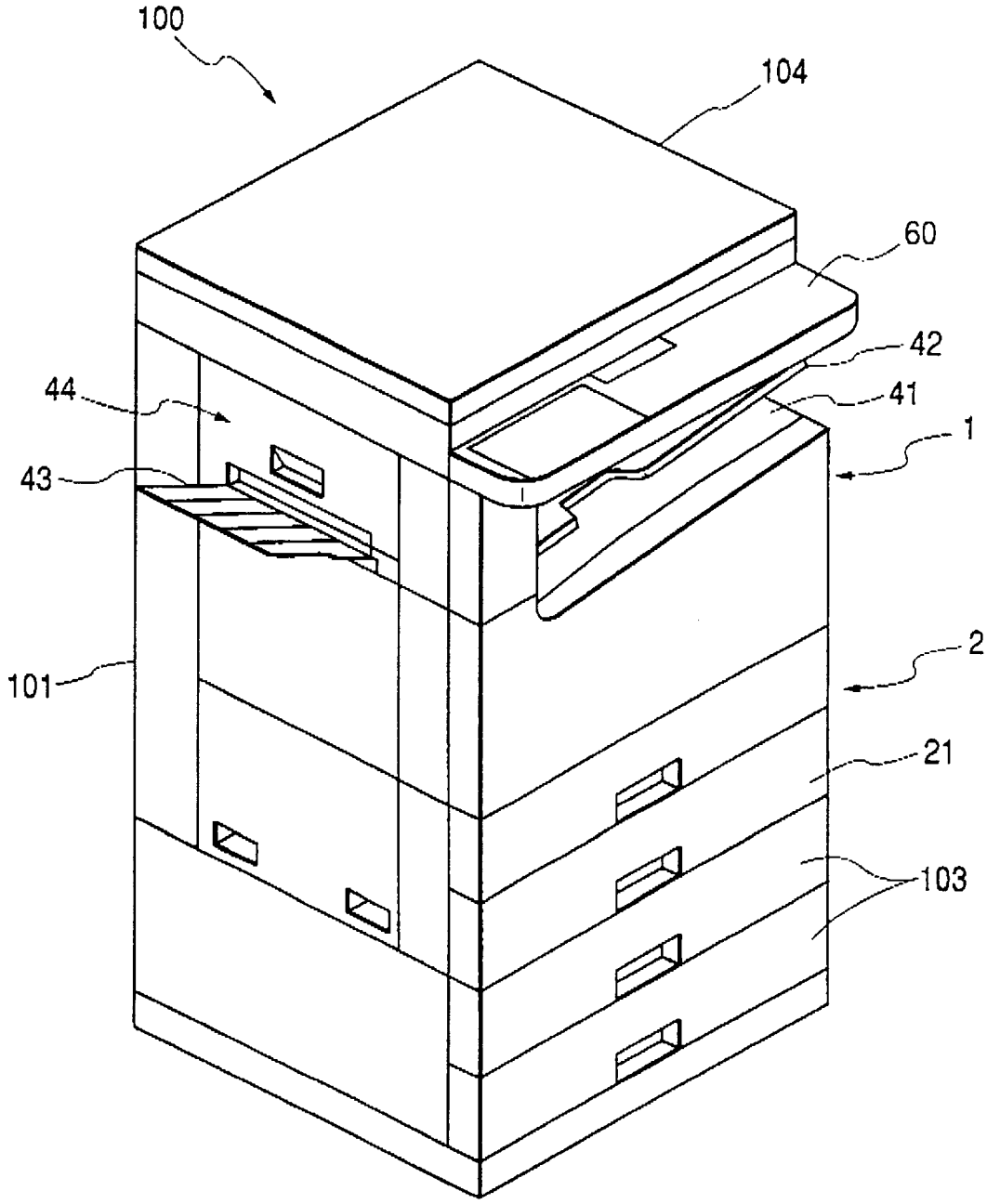
FIG. 2 is a perspective view of the image forming apparatus as seen from another direction.
Figure 3:
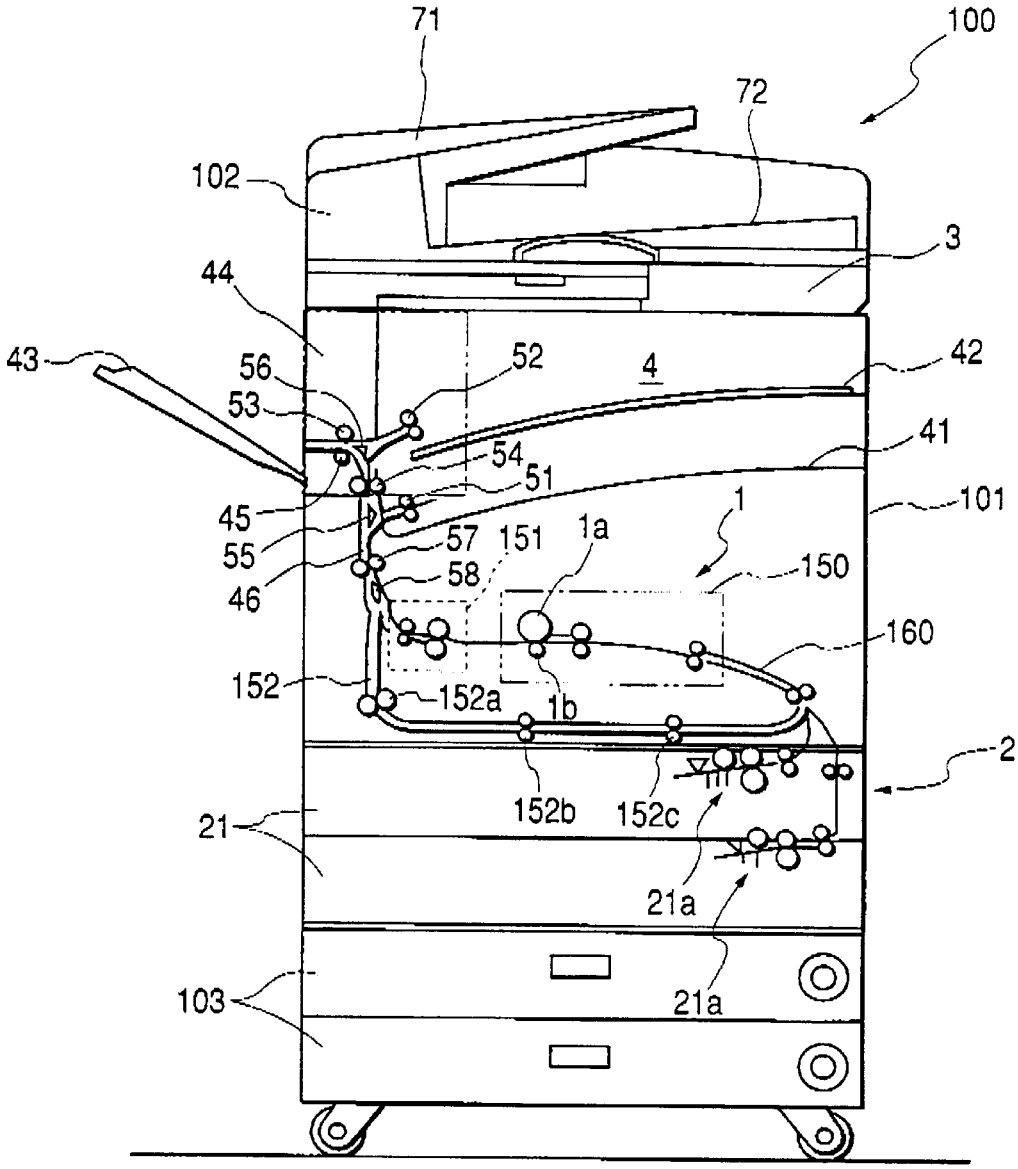
FIG. 3 is a diagram schematically showing the construction of the image forming apparatus.

FIG. 1 is a perspective view of an image forming apparatus according to an embodiment of the present invention; FIG. 2 is a perspective view of the image forming apparatus as seen from another direction; and FIG. 3 is a diagram schematically showing the construction of the image forming apparatus, In FIGS. 1 to 3, reference numeral 100 indicates an image forming apparatus, which is equipped with an apparatus main body 101, option sheet feeding cassettes 103 provided as an option in the lower portion of the apparatus main body 101, and a pressure plate 104 mounted to the top surface of the apparatus main body 101 or an automatic document feeder (hereinafter referred to as the ADF) 102 provided as an option on the top surface of the apparatus main body 101. In FIGS. 1 and 2, the pressure plate 104 is provided on the top surface of the apparatus main body 101, and in FIG. 3, the ADF 102 is provided on the top surface of the apparatus main body 101.

The image forming apparatus 100 consists of a so-called digital multifunction printer which serves as both a copying machine and a facsimile apparatus and which effects image formation by converting the image information (optical signal) of a read original into an electric signal.

In substantially the central portion of the apparatus main body 101, there is provided an image forming portion 1 having a photosensitive drum 1*a*, a transferring roller 1*b*, etc. Below the image forming portion 1, there is provided a sheet feeding portion 2, and in the uppermost portion, there is provided a scanner portion 3 serving as an image reading portion. In the apparatus main body 101 of this embodiment, the image forming portion 1 and the scanner portion 3 are separated from each other, taking advantage of the fact that it is a digital apparatus. The portion between them is used as a sheet discharging space 4 with open sides, thereby eliminating any wings and realizing a space-saving image forming apparatus having no protrusions on the apparatus sides.

The image forming portion 1 is formed as a well-known electrophotographic print engine, and contains an electrophotographic process means 150, a fixing apparatus 151, a laser writing device (not shown), etc.

The image forming portion is not restricted to the electrophotographic type in which a toner image on a photosensitive drum is transferred to a sheet; it may also be of the ink jet type in which ink is ejected onto a sheet.

The sheet feeding portion 2 has two stages of sheet feeding cassettes 21, and sheets accommodated in the sheet feeding cassettes 21 or the option sheet cassette 103 are supplied to the image forming portion 1 by pick-up rollers 21*a*. The sheet feeding cassettes 21 and 103 are of the front loading type which are pulled out to the front side of the apparatus for sheet supply, and each of them has a pull-out handle at the center of the cassette front surface.

Further, a contact glass (not shown) is arranged on the top surface of the scanner portion 3, and a scanner unit (not shown) is arranged below the same.

The sheet discharging space 4 has walls on two sides except for the front and right-hand sides. That is, it has walls on the left-hand side and the back side in FIG. 3 and is blocked up on the upper and lower sides by the scanner portion 3 and the image forming portion 1. Further, the sheet discharging space 4 is equipped with a first sheet discharging tray 41 provided on the top surface of the image forming portion, and a second sheet discharging tray 42 (first discharging portion or first placing portion) provided at the center of the sheet discharging space 4.

The ADF 102 is mounted to the upper portion of the apparatus main body 101 by a hinge (not shown) provided on the back side of the apparatus, and is arranged so as to be capable of exposing and covering the contact glass on the top surface of the scanner portion 3.

The construction and operation of the ADF 102 is the same as those of a conventionally well-known one, so that a detailed description thereof will be omitted. When a bundle of originals (not shown) are placed on an original tray 71, the originals are conveyed one by one, starting from the lowermost one, onto the contact glass. After this, when the read scanning by the scanner portion 3 is completed, the originals are discharged onto an original discharging tray 72.

When performing copying without using automatic document feeding function or when copying pages of a book or a notebook, the ADF 102 can be used as a pressure plate. Further, when there is no ADF 102, which is an option, the pressure plate 104 for pressing the original against the contact glass is mounted as shown in FIGS. 1 and 2.

Reference numeral 43 indicates a second sheet discharging portion, or a third sheet discharging tray which is a second placing portion, which is provided on the left-hand outer side of the apparatus main body 101 so as to be opposite to the sheet discharging space 4, and reference numeral 44 indicates an option sheet discharging unit forming a side wall of the sheet discharging space 4. The option sheet discharging unit 44 is a unit making it possible to effect sorting out in, for example, copying, printing, and facsimile communication. When sorting out is required, it is detachably attached to the apparatus main body 101.

Then, when such an option sheet discharging unit 44 is provided, and, for example, facsimile sheets are stacked on the third sheet discharging tray 43, it is possible to increase the total number of sheets stacked in the image forming apparatus 100 and to stack the sheets in a state in which they are sorted out.

Figure 4:
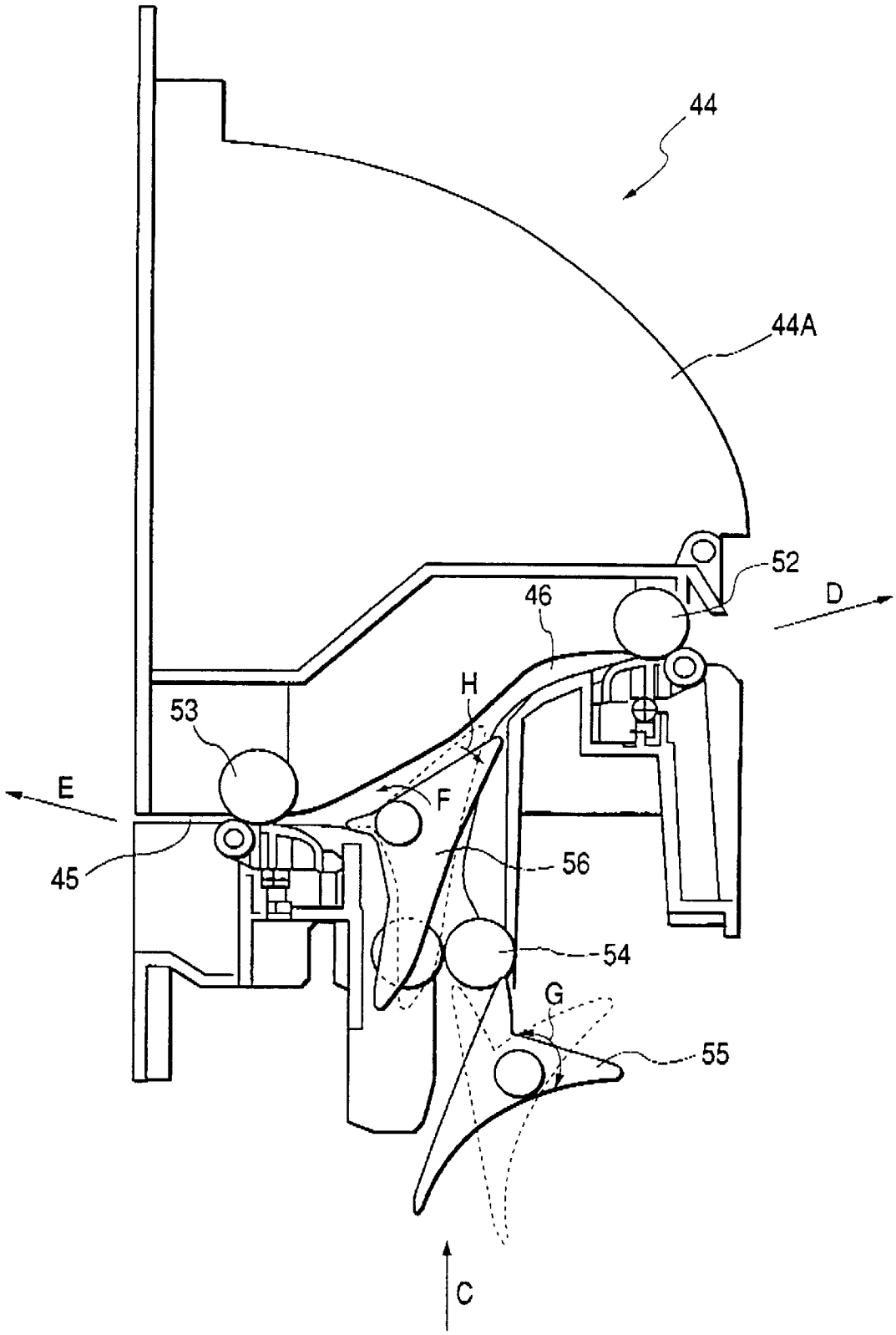
FIG. 4 is a sectional view of an option sheet discharging unit provided on the image forming apparatus.

As shown in FIG. 4, in the option sheet discharging unit which is a sheet discharging direction control means, there are provided a main body portion 44A, and three rollers: a second sheet discharging roller 52 which a first discharging means or a conveyance rotary member; a third sheet discharging roller 53 which is a second discharging means; and a longitudinal path roller 54. The longitudinal path roller 54, the second sheet discharging roller 52, and the third sheet discharging roller 53 are respectively driven by separate motors.

Figure 5:
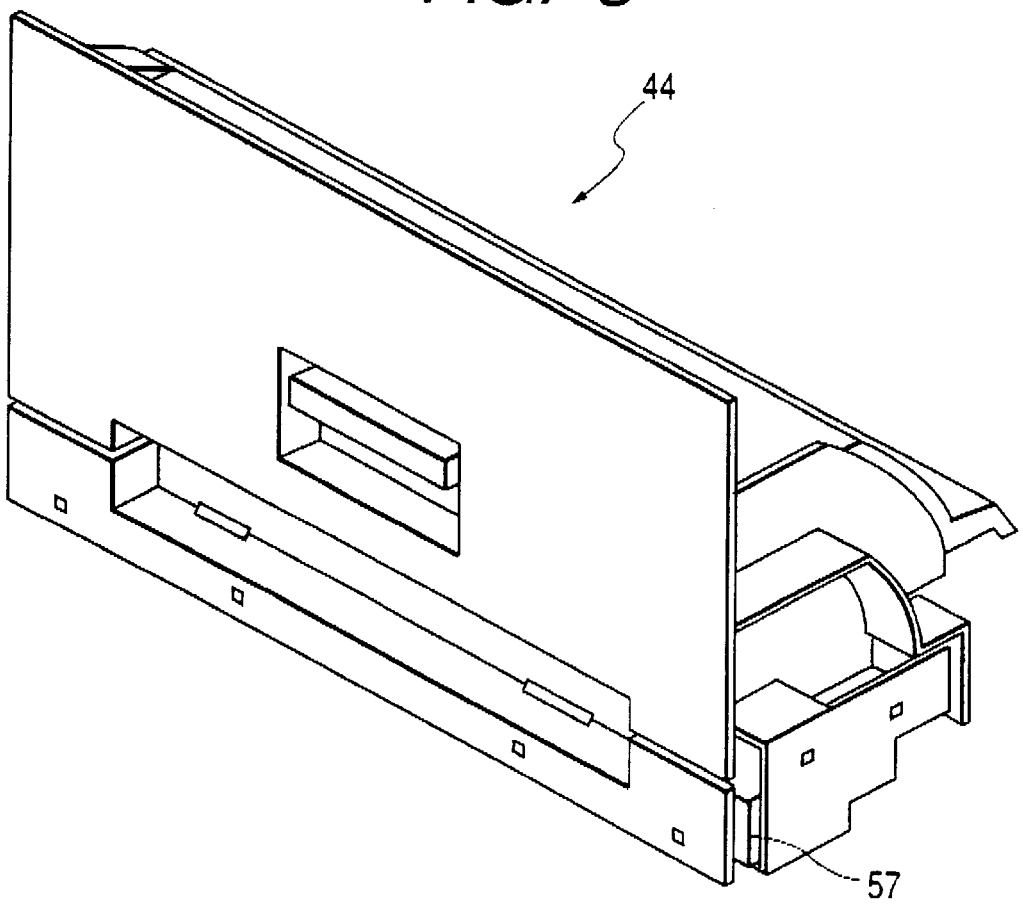
FIG. 5 is a perspective view of the option sheet discharging unit.

Further, this option sheet discharging unit 44 is equipped with a first flapper 55 and a second flapper 56 serving as a conveyance route switching means or a guide member. The first flapper 55 is rotatable in the direction of the arrow G by a solenoid 57 shown in FIG. 5. The second flapper 56 is biased in the direction of the arrow H by a spring (not shown). When it is raised by a sheet, it can be rotated in the direction of the arrow F against the resilient force of the spring.

Further, in this option sheet discharging unit, there is provided a sheet discharging path 46 which is a first sheet conveyance route or a first conveyance path for discharging sheets onto the second discharging tray 42 which is the first discharging portion provided on one side of the main body portion 44A. When discharging sheets onto the second sheet discharging tray 42, they are discharged onto the second sheet discharging tray 42 by the second sheet discharging roller 52 by way of the sheet discharging path 46.

Further, when the third sheet discharging tray 43 provided on the other side of the main body portion 44A is mounted, the option sheet discharging unit 44 is equipped with an option discharging path 45 which is a second sheet conveyance route or a second conveyance path for discharging sheets onto the third sheet discharging tray 43. When discharging a sheet which has undergone recording in the image forming portion 1 onto the third discharging tray 43, it is discharged onto the third sheet discharging tray 43 by way of the option discharging path 45.

The sheet discharging path 46 and the option discharging path 45 are formed by guides 46*a*, 46*b*, 46*c*, 46*d*, 46*e*, 45*a*, 45*b*, etc. which come into contact with sheets to thereby guide them.

In this embodiment, the option discharging path 45 which is a reversing path leading to the third sheet discharging tray 43 is opposite by approximately 180 degrees and horizontal with respect to the direction D in which sheets are discharged onto the second sheet discharging tray 42.

Figure 6:
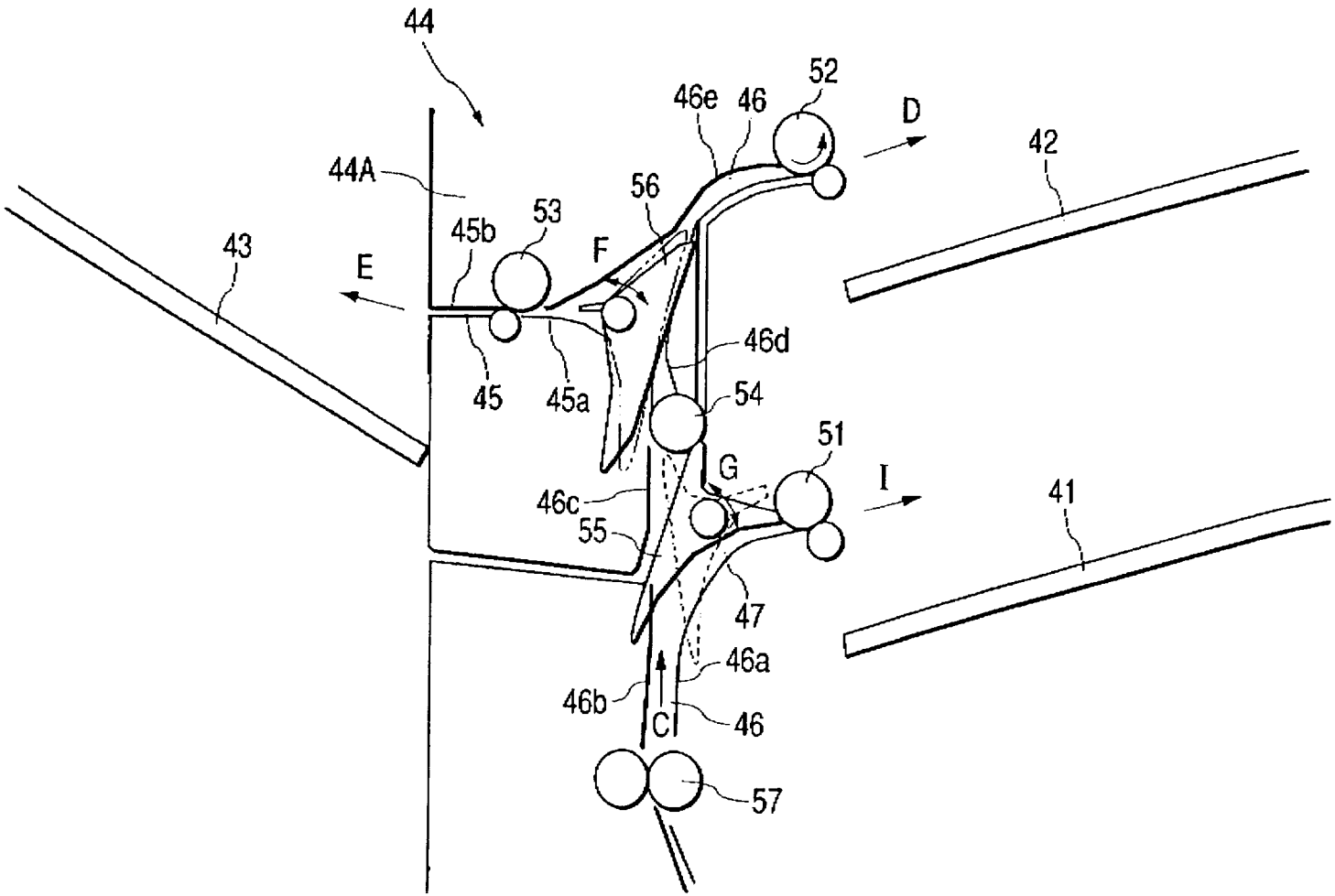
FIG. 6 is a sectional view showing the sheet discharging portion when the option sheet discharging unit is attached to the apparatus main body.

FIG. 6 is a sectional view showing the sheet discharging portion when the option sheet discharging unit 44 is attached to the apparatus main body 101. Sheets conveyed from the direction of the arrow C pass the first conveyance route 47 formed by the first flapper 55 which is normally in the position indicated by the solid line and are discharged in the direction of the arrow I by the first sheet discharging roller 51 to be stacked on the sheet discharging tray 41.

When discharging sheets, for example, onto the second sheet discharging tray 42 for sorting them out, the first flapper 55 is rotated to the position indicated by the dashed line, whereby the sheet conveyed from the direction of the arrow C passes the first flapper 55 and passes the longitudinal path roller 54 before raising the second flapper 56 due to its rigidity, the sheet being conveyed to the sheet discharging path 46 while displacing the second flapper 56 to a first position indicated by the dashed line for causing the sheet to be conveyed toward the sheet discharging path 46. Thereafter, the sheet is discharged in the direction of the arrow D by the second sheet discharging roller 52 rotating in the direction indicated by the arrow and stacked on the second sheet discharging tray 42.

When discharging a sheet onto the third sheet discharging tray 43 for sorting out, the sheet first passes the longitudinal path roller 54 as in the case in which the sheet is discharged onto the second sheet discharging tray 42, and is conveyed to the sheet discharging path 46 while raising the second flapper 56.

Next, the sheet leading end is detected by a sensor (not shown) provided in the sheet discharging path 46, and when it has been detected that the sheet trailing end has left the second flapper 56 from the time elapsed since the detection of the sheet leading end calculated according to the sheet size, the second sheet discharging roller 52 starts reverse rotation, and, at the same time, driving force is transmitted to the third sheet discharging roller 53. When the trailing end of the sheet passes the second flapper 56, the second flapper 56 is displaced (restored) by a spring to a second position indicated by the solid line for causing the sheet to be conveyed to the option discharging path 45. As a result, the sheet is conveyed to the option discharging path 45 by way of the second flapper 56, and is then discharged in the direction of the arrow E and stacked on the third sheet discharging tray 43.

When performing image formation on both sides of a sheet, a sheet conveyed from a fixing apparatus 151 is guided to the sheet discharging path 46, and after the trailing end of the sheet has passed the first flapper 58, the first flapper 58 is switched and the longitudinal path roller 54 and the main body longitudinal path roller 57 are reversed to switch back the sheet, which is guided to a two-side path 152 which is a two-side conveyance path by the first flapper. The sheet is guided along the two-side path 152 by two-side conveyance roller pairs 152*a*, 152*b*, and 152*c*, and enters a sheet feeding path 160 before being sent to the image forming portion 1 again.

Next, the copying operation in the image forming apparatus 100 constructed as described above and the actual sheet movement in the sheet discharging portion will be described with reference to the case in which the ADF 102 is used as the pressure plate.

First, in FIG. 3, an original is placed on a contact glass (not shown) on the top surface of the scanner portion 3 and the ADF 102 is closed. Thereafter, the number of copies etc. are designated at an operating portion 60 (See FIG. 2) and a start button is pressed, whereby the reading of the original by the scanner unit is started, and the image information of the original read is digitized through photoelectric conversion for image processing.

Then, on the basis of the processed signal, the laser writing device of the image forming portion 1 is driven, and an electrostatic latent image is formed on the photosensitive drum. Thereafter, this latent image is visualized as a toner image, which is transferred to a sheet of the sheet feeding cassette 21 or the sheet feeding table 103 fed from the sheet feeding portion 2. Further, the toner image transferred to the sheet is fixed by the fixing apparatus 151, and the sheet is conveyed to the sheet discharging portion 4.

Figure 7:
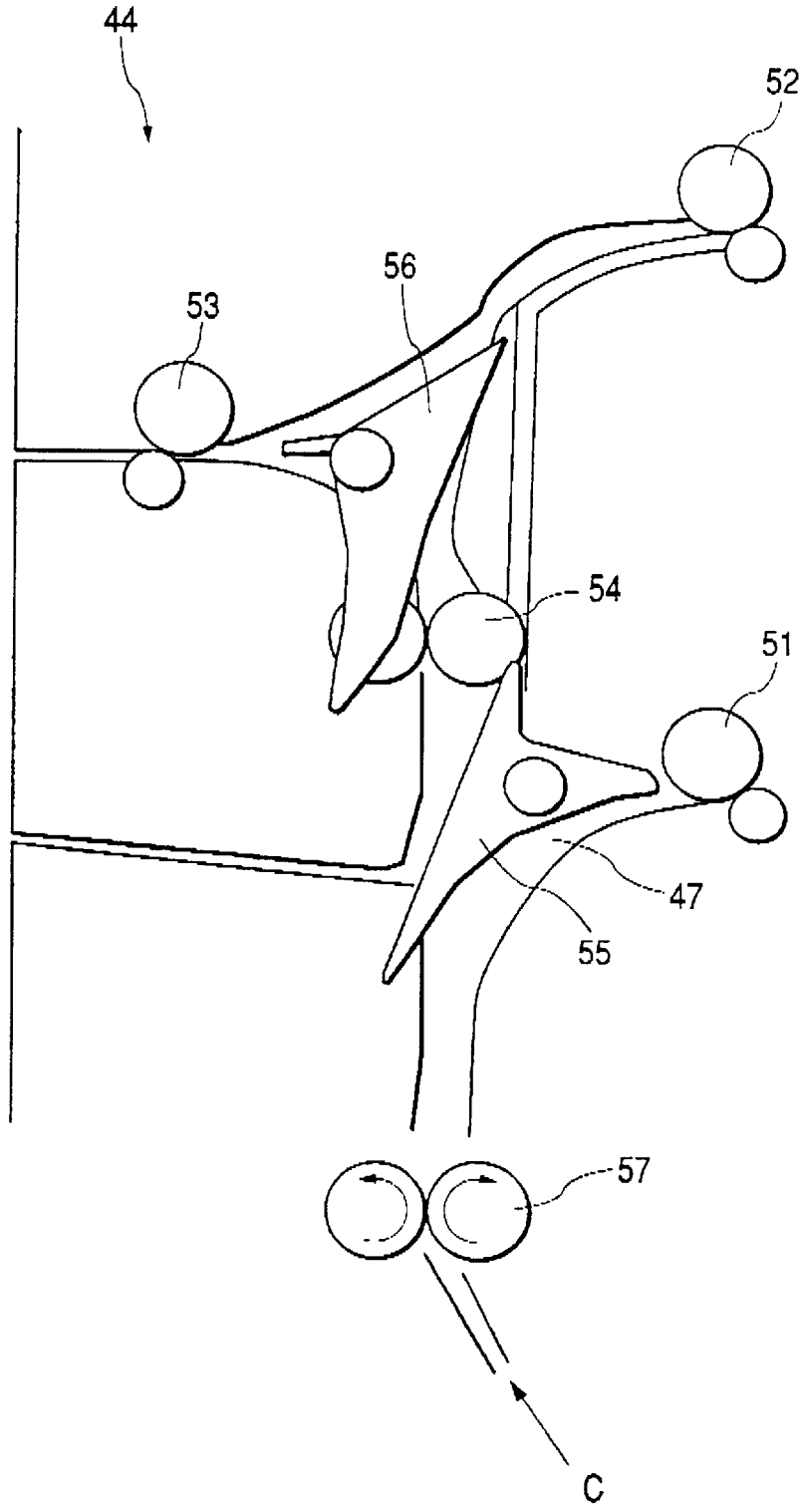
FIG. 7 is a diagram showing the condition when the driving of a main body longitudinal path roller provided in the option sheet discharging unit is started.

When stacking a sheet on the sheet discharging tray 41, the sheet is conveyed to the fixing apparatus 151, and then the main body longitudinal path roller 57 is started to be driven as shown in FIG. 7 after a predetermined time, whereby the sheet conveyed from the direction of the arrow C passes the first conveyance path 47 formed by the first flapper 55 at the position indicated by the solid line, and is discharged by the first sheet discharging roller 51 and stacked on the sheet discharging tray 41.

Figure 8:
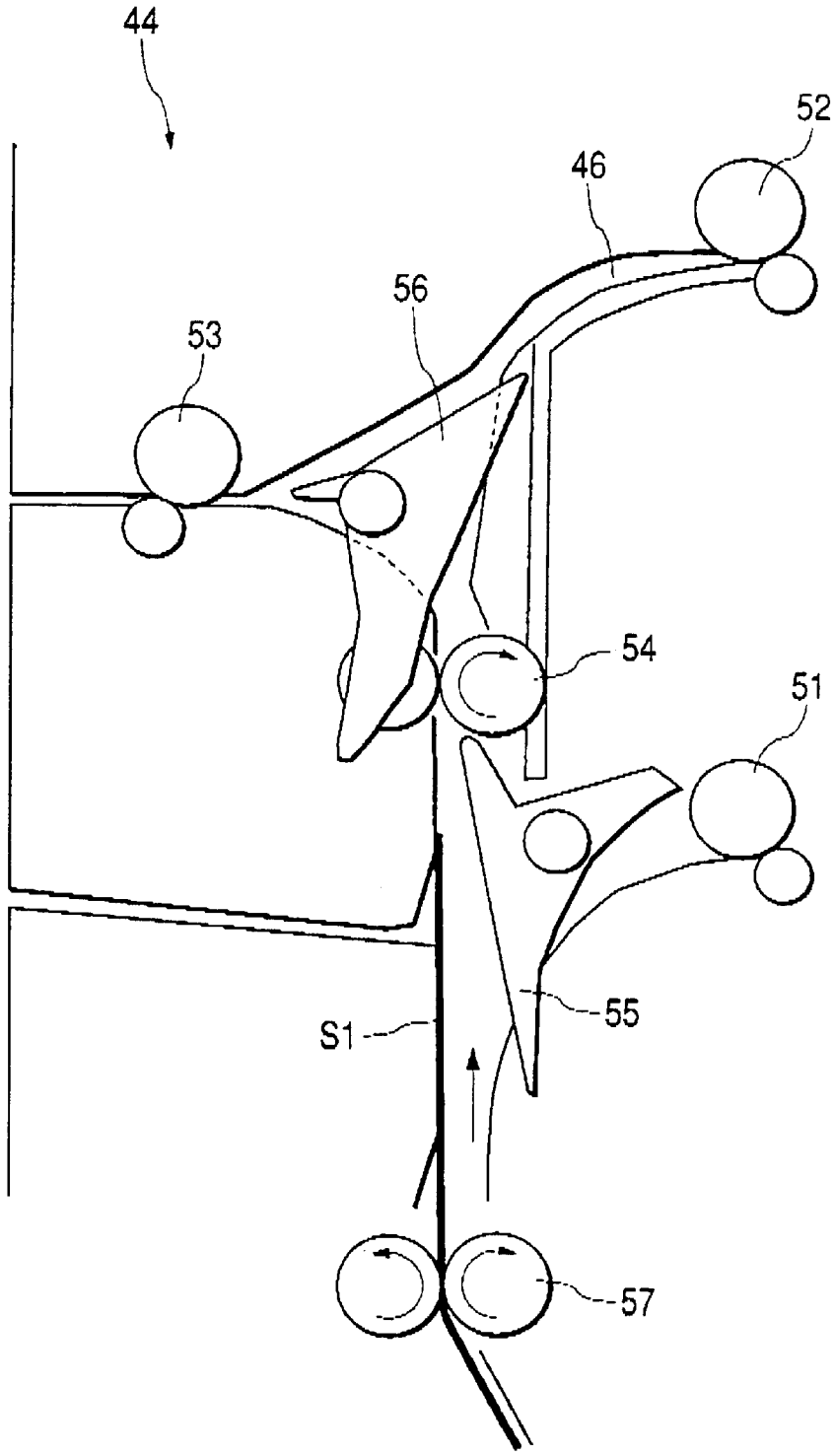
FIG. 8 is a first diagram showing how the option sheet discharging unit discharges a sheet onto a second sheet discharging tray provided in the image forming apparatus.

When discharging a sheet onto the second sheet discharging tray 42 for sorting out, the first flapper 55 is first rotated and moved to the position shown in FIG. 8, whereby the sheet S1 conveyed passes the first flapper 55 and is conveyed toward the longitudinal, path roller 54.

Figure 9:
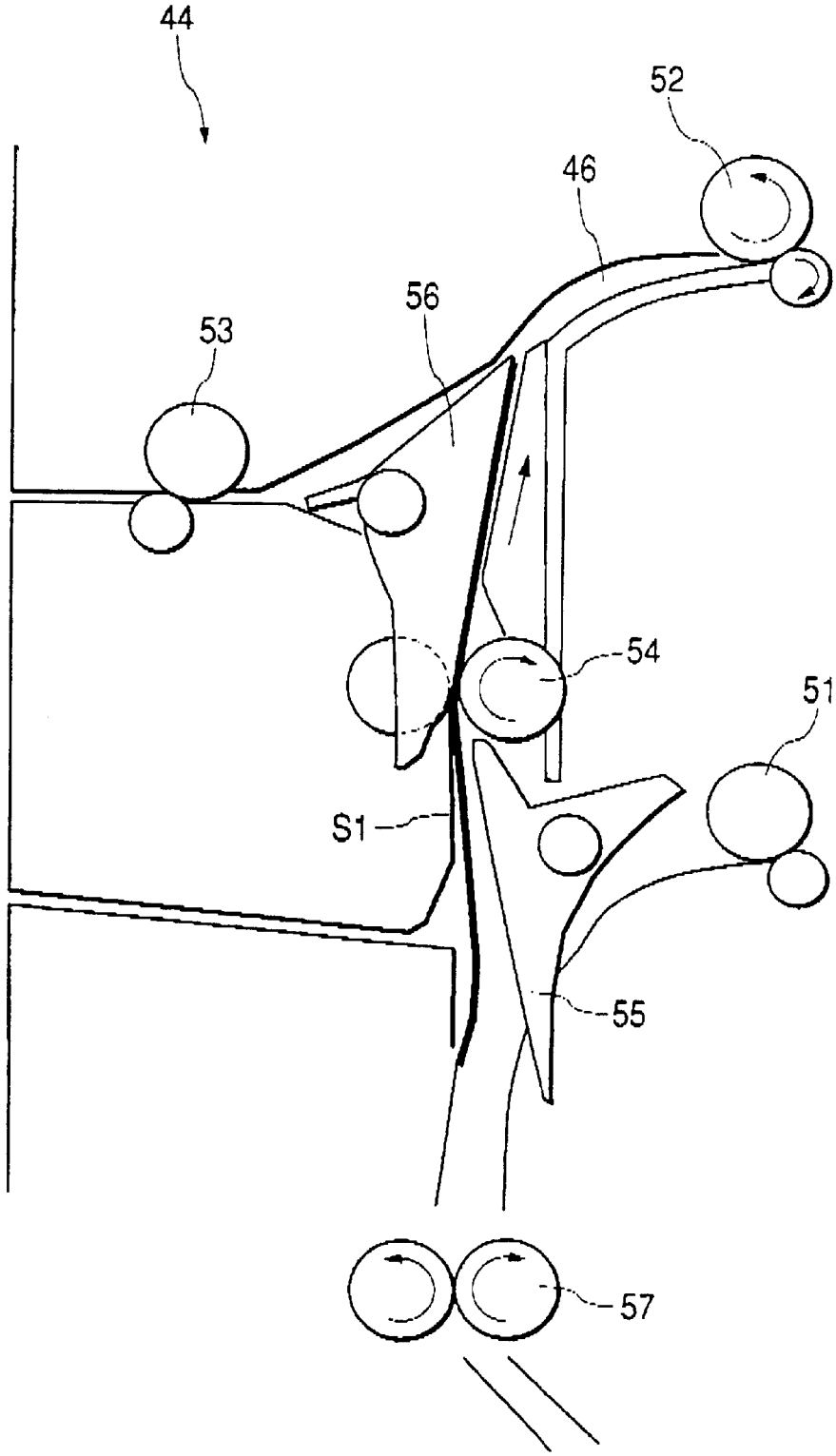
FIG. 9 is a second diagram showing how the option sheet discharging unit discharges a sheet onto the second sheet discharging tray.

Then, after passing the longitudinal path roller 54 as shown in FIG. 9, the sheet S1 is conveyed toward the sheet discharging path 46 while raising the second flapper 56 due to its rigidity. Thereafter, it is discharged by the second sheet discharging roller 52 rotating in the direction indicated by the arrow and is stacked on the second sheet discharging tray 42.

When discharging the sheet S1 onto the third sheet discharging tray 43 for sorting out, the sheet passes the longitudinal path roller 54 as show in the drawing, and is conveyed to the sheet discharging path 46 while raising the second flapper 56 due to its rigidity; when the trailing end of the sheet S1 has passed the fixing apparatus 151, the speed at which the sheet S1 is conveyed is increased by 2.5 times after a predetermined time, and, at the same time, the driving of the second sheet discharging roller 52 is started.

Figure 10:
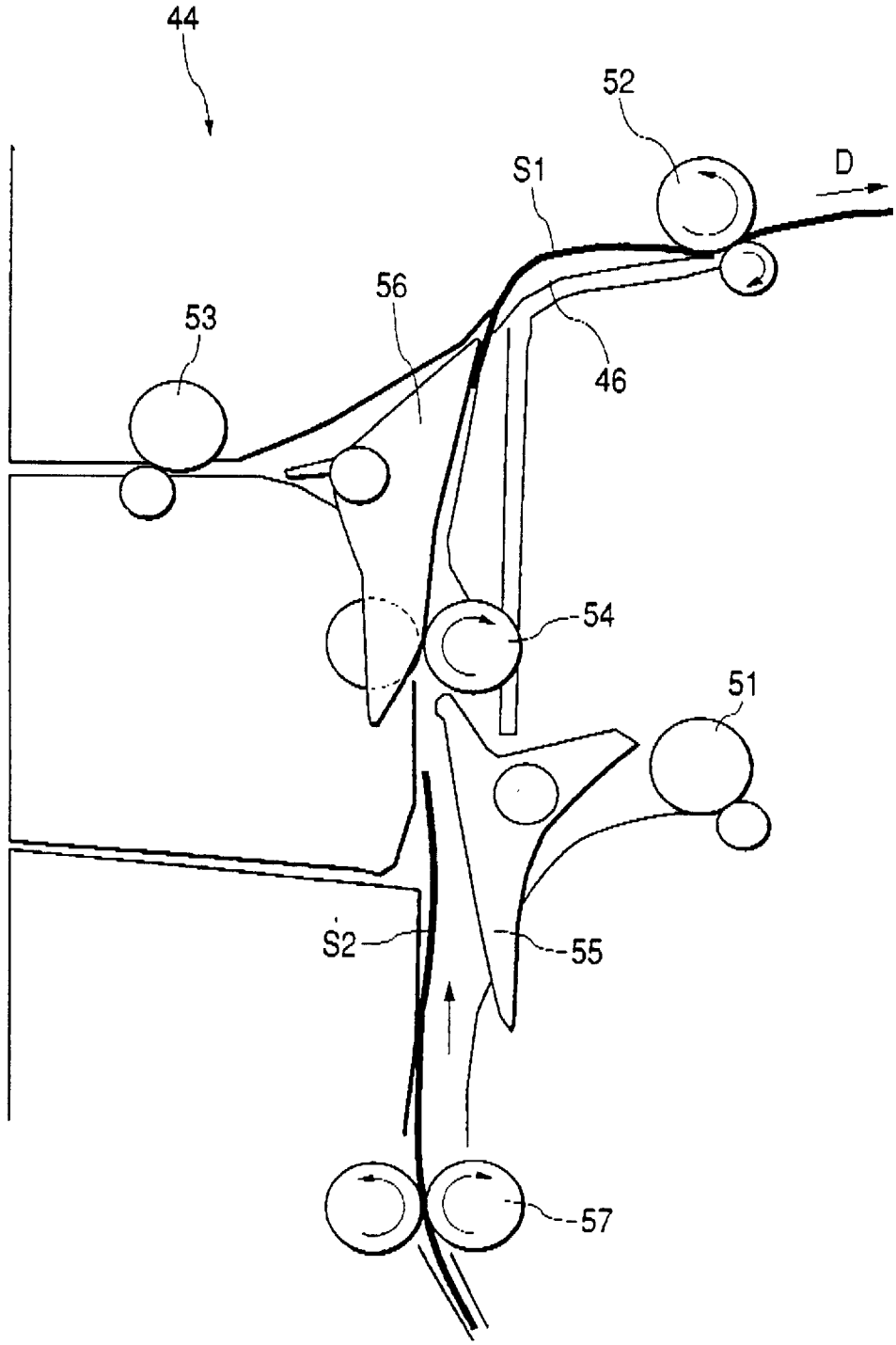
FIG. 10 is a first diagram showing how the option sheet discharging unit discharges a sheet onto a third sheet discharging tray.

As a result, as shown in FIG. 10, the sheet S1 is partly discharged in the direction of the arrow D by the second sheet discharging roller 52 rotating in the direction indicated by the arrow. By thus increasing the speed at which the sheet S1 is conveyed by 2.5 times, interference between the sheet S1 to be reversed and the sheet S2 conveyed next can be prevented.

Figure 11:
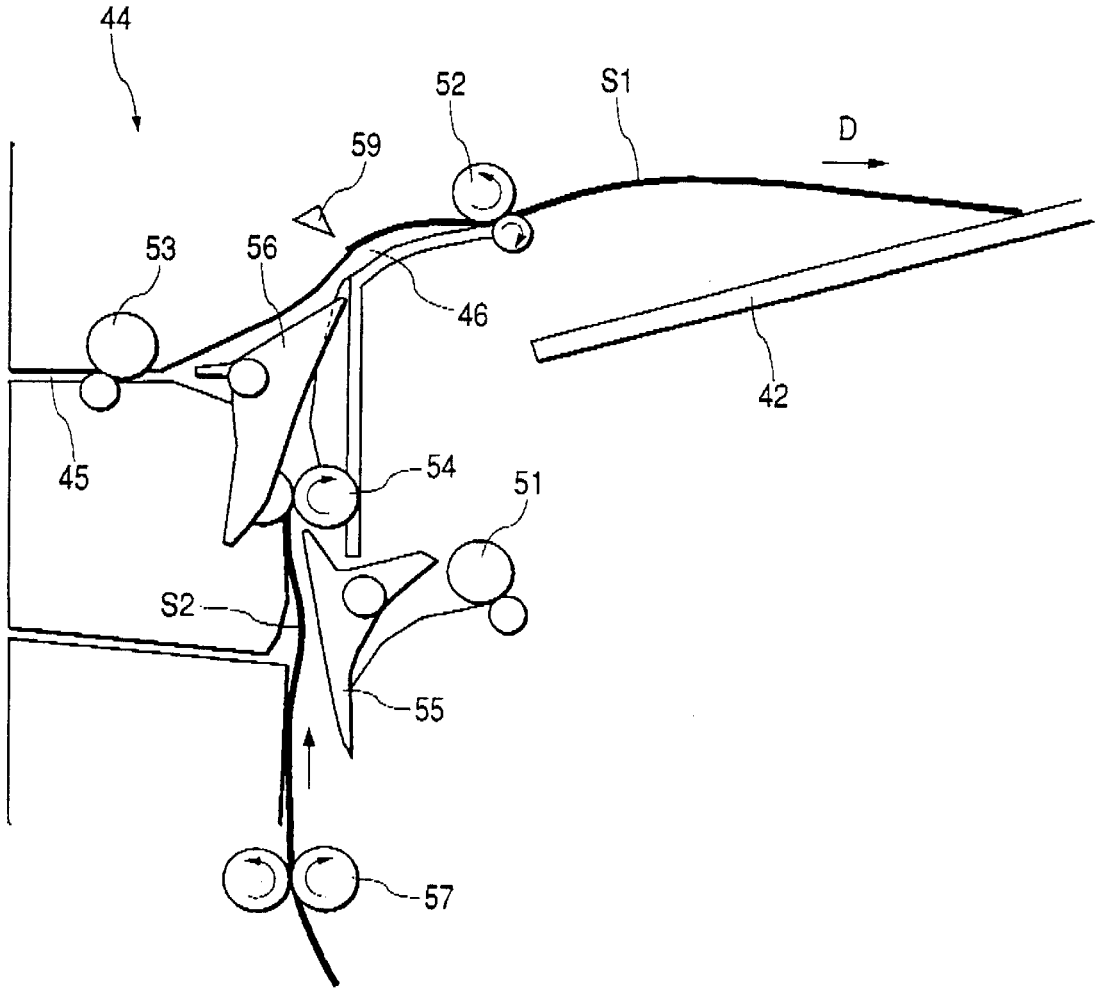
FIG. 11 is a second diagram showing how the option sheet discharging unit discharges a sheet onto the third sheet discharging tray.

Further, when the trailing end of the sheet S1 conveyed by the second sheet discharging roller 52 leaves the second flapper 56 thereafter, the second flapper 56 is restored to the original standby position as shown in FIG. 11 by a spring (not shown).

Next, the time that has elapsed since the detection of the forward end of the sheet S1 by a photo sensor (not shown) provided in the sheet discharging path 46 is calculated according to the size of the sheet S1, and, when it is determined on the calculated value that the trailing end of the sheet S1 has reached the reversing point 59, the driving of the second sheet discharging roller 52 is stopped, and the second sheet discharging roller 52 starts to rotate in the reverse direction after a predetermined time.

Figure 12:
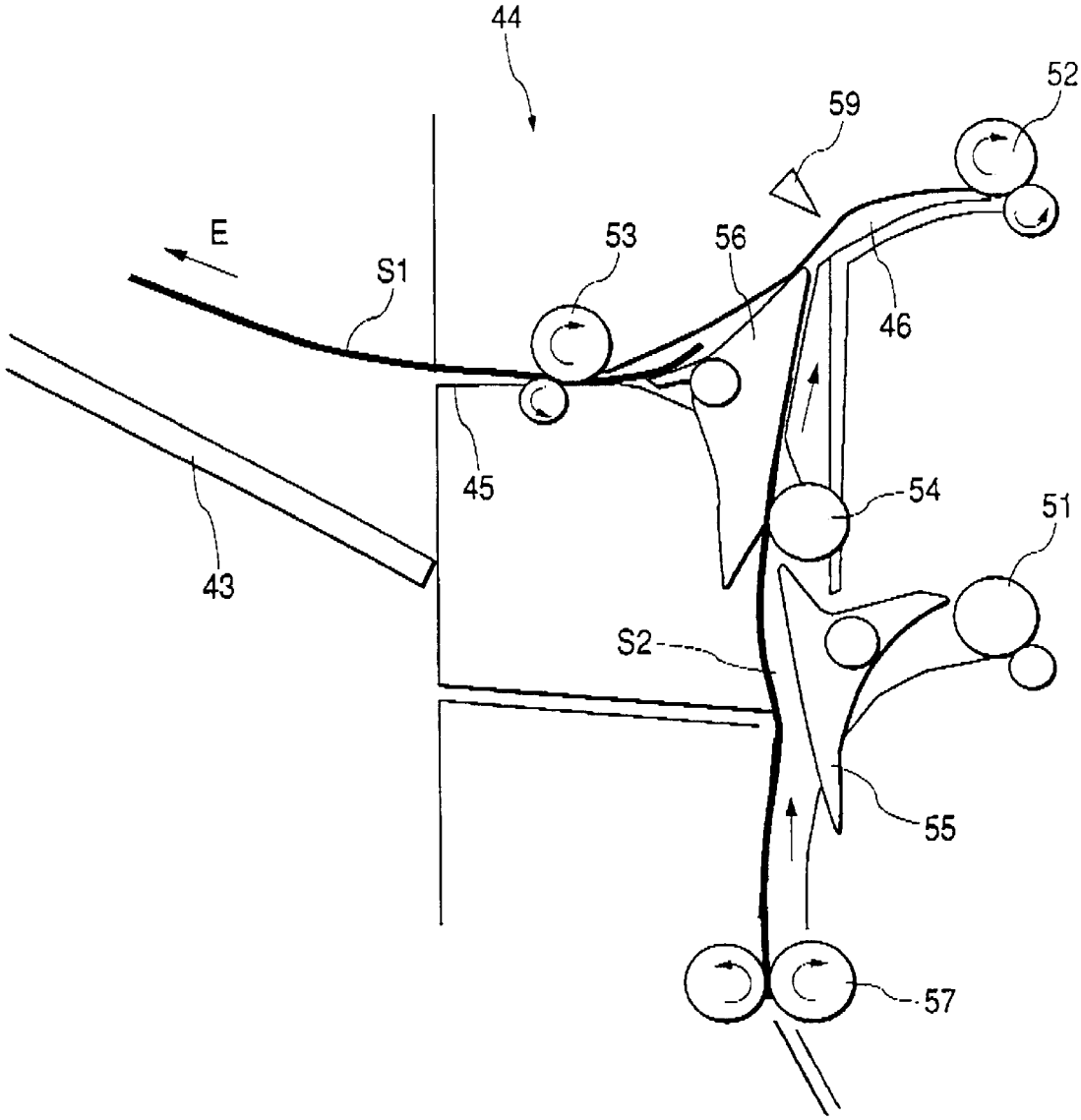
FIG. 12 is a third diagram showing how the option sheet discharging unit discharges a sheet onto the third, sheet discharging tray.

At the same time, the driving of the third sheet discharging roller 53 is started as shown in FIG. 12, and the sheet S1 is conveyed toward the option discharging path 45. The conveyance by the second sheet discharging roller 52 and the third sheet discharging roller 53 at this time is effected at a speed increased by 2.5 times.

Figure 13:
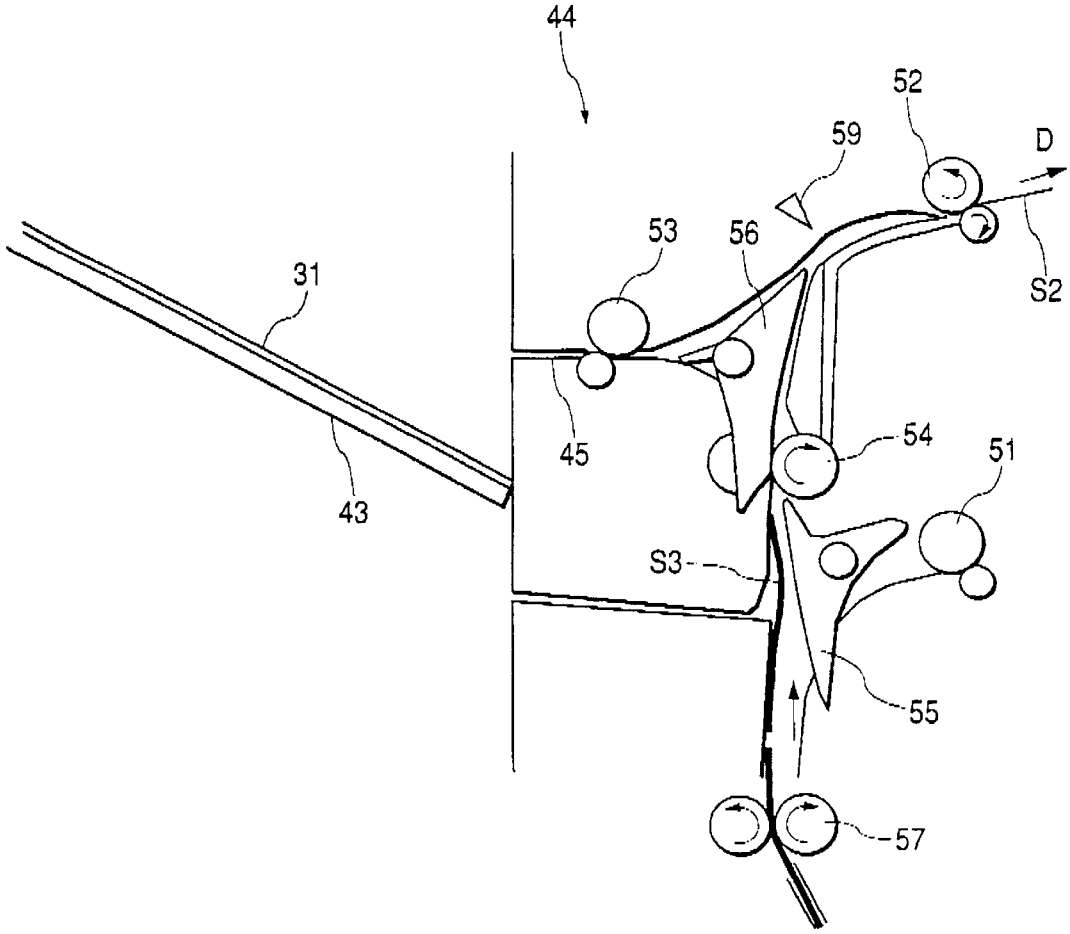
FIG. 13 is a fourth diagram showing how the option sheet discharging unit discharges a sheet onto the third sheet discharging tray.

Then, the sheet S1 is conveyed in the direction of the arrow E by the rotation of the second sheet discharging roller 52 and the third sheet discharging roller 53, and stacked facedown on the third sheet discharging tray 43 as shown in FIG. 13. By repeating this operation, sheets are successively stacked on the third sheet discharging tray 43 in the page order.

When thus discharging sheets onto the third sheet discharging tray 43 by the option sheet discharging unit 44, sheets with images formed thereon are conveyed toward the sheet discharging path 46, and are then conveyed toward the option discharging path 45 by reversing the second sheet discharging roller 52, whereby it is possible to discharge the sheets without involving any change in the page order.

That is, by reversing the second sheet discharging roller 52 to convey the sheets toward the option discharging path 45 after conveying them toward the sheet discharging path 46, in other words, by using the sheet discharging path 46 also as the sheet reversing path, it is possible to discharge the sheets without having to provide a sheet reversing path anew or involving any change in page order.

Figure 14:
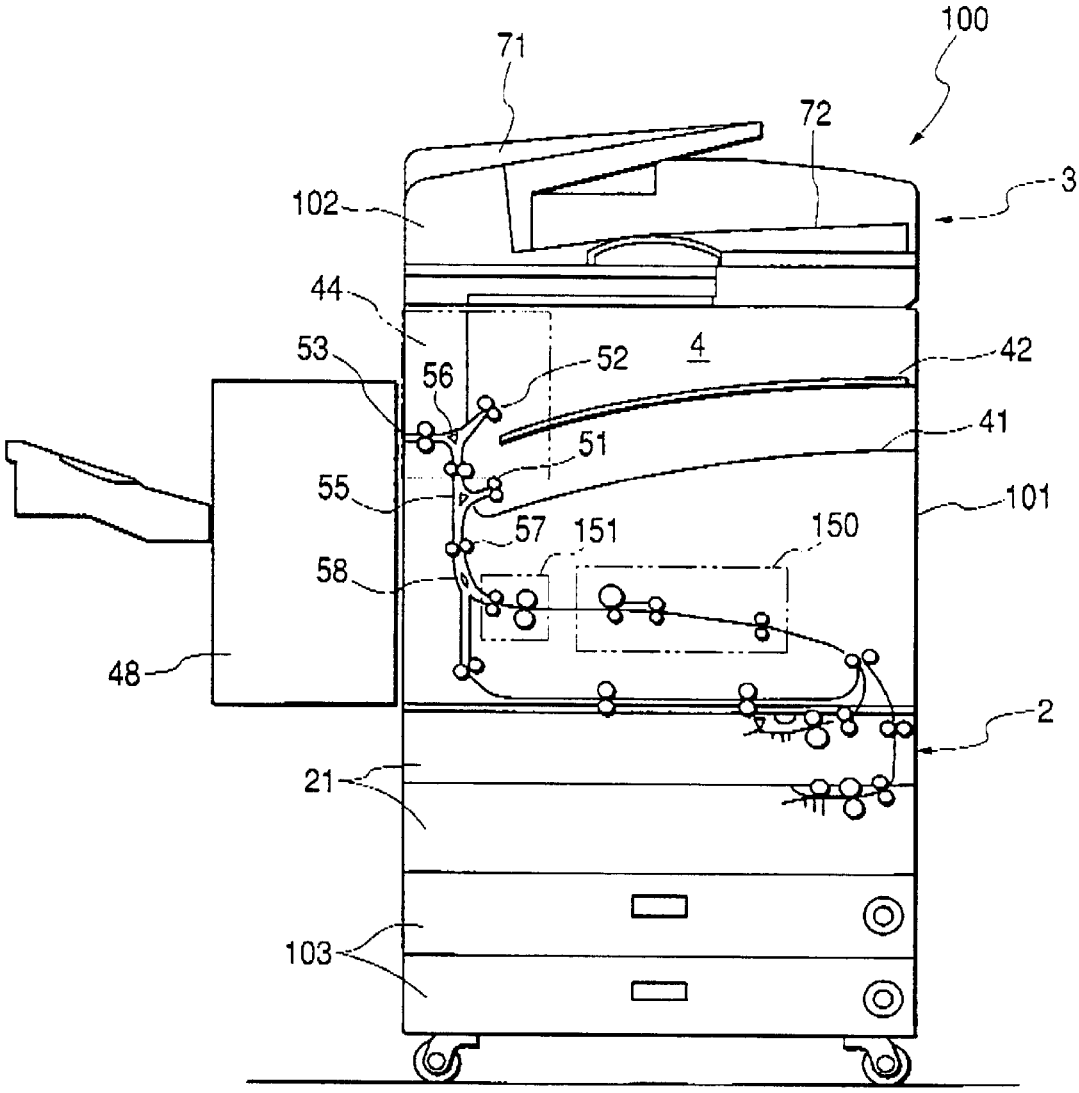
FIG. 14 is a diagram showing the construction of an image forming apparatus according to another embodiment of the present invention.
Figure 15:
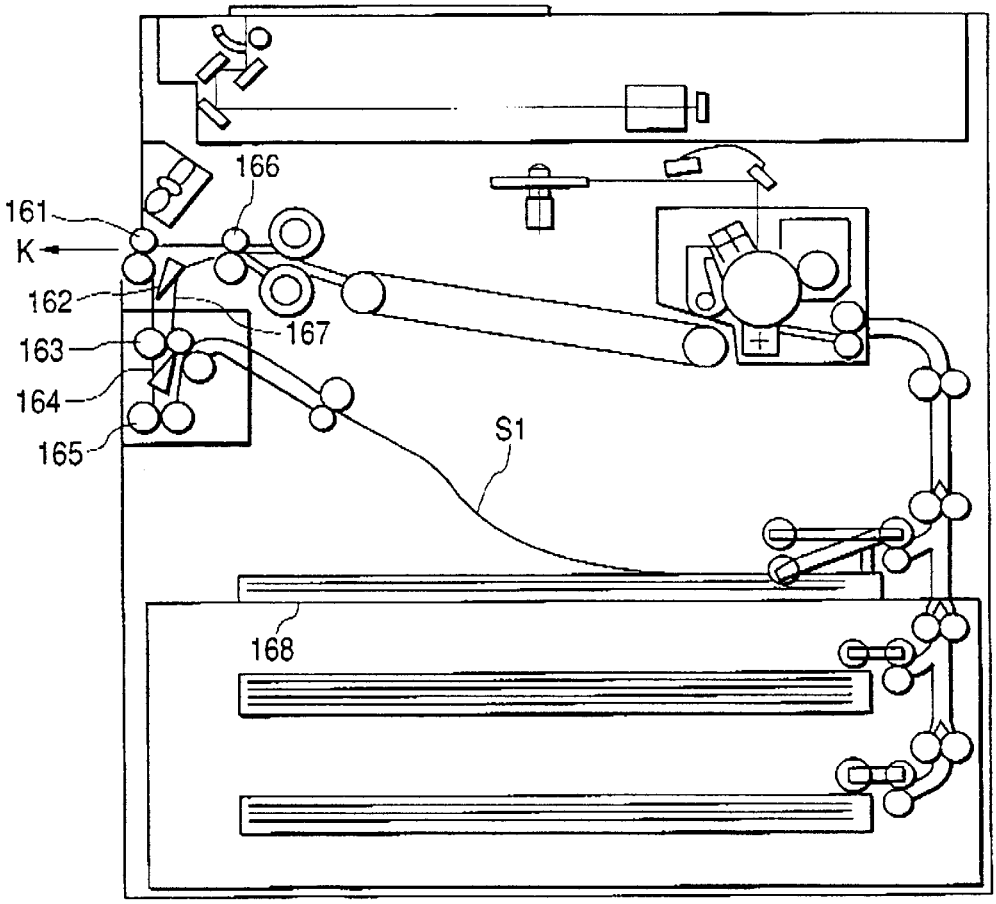
FIG. 15 Prior Art
FIG. 15 is a diagram showing an example of a conventional image forming apparatus having a sheet reversing path.
Figure 16:
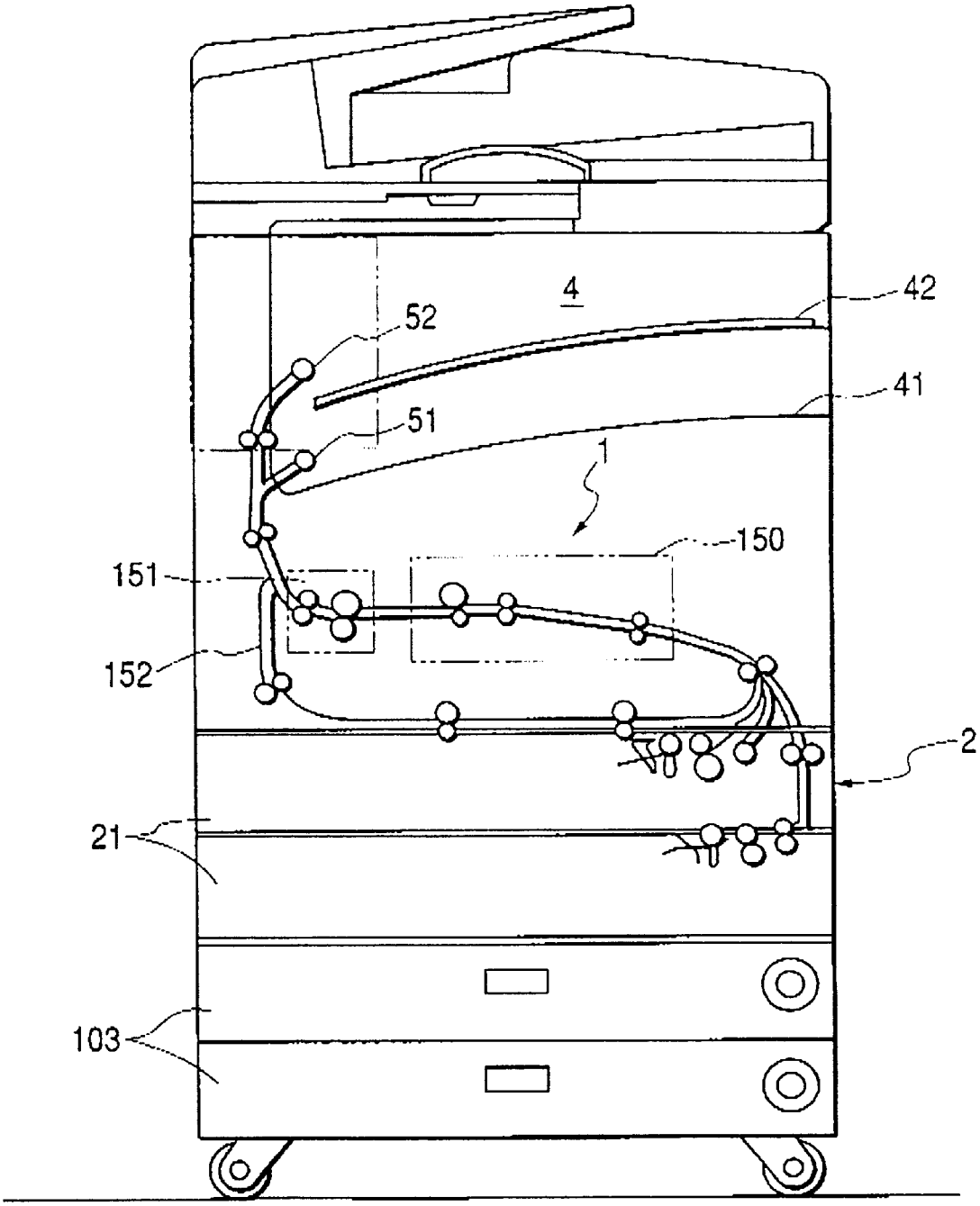
FIG. 16 Prior Art
FIG. 16 is a diagram showing another example of a conventional image forming apparatus having a sheet reversing path.
Figure 17:
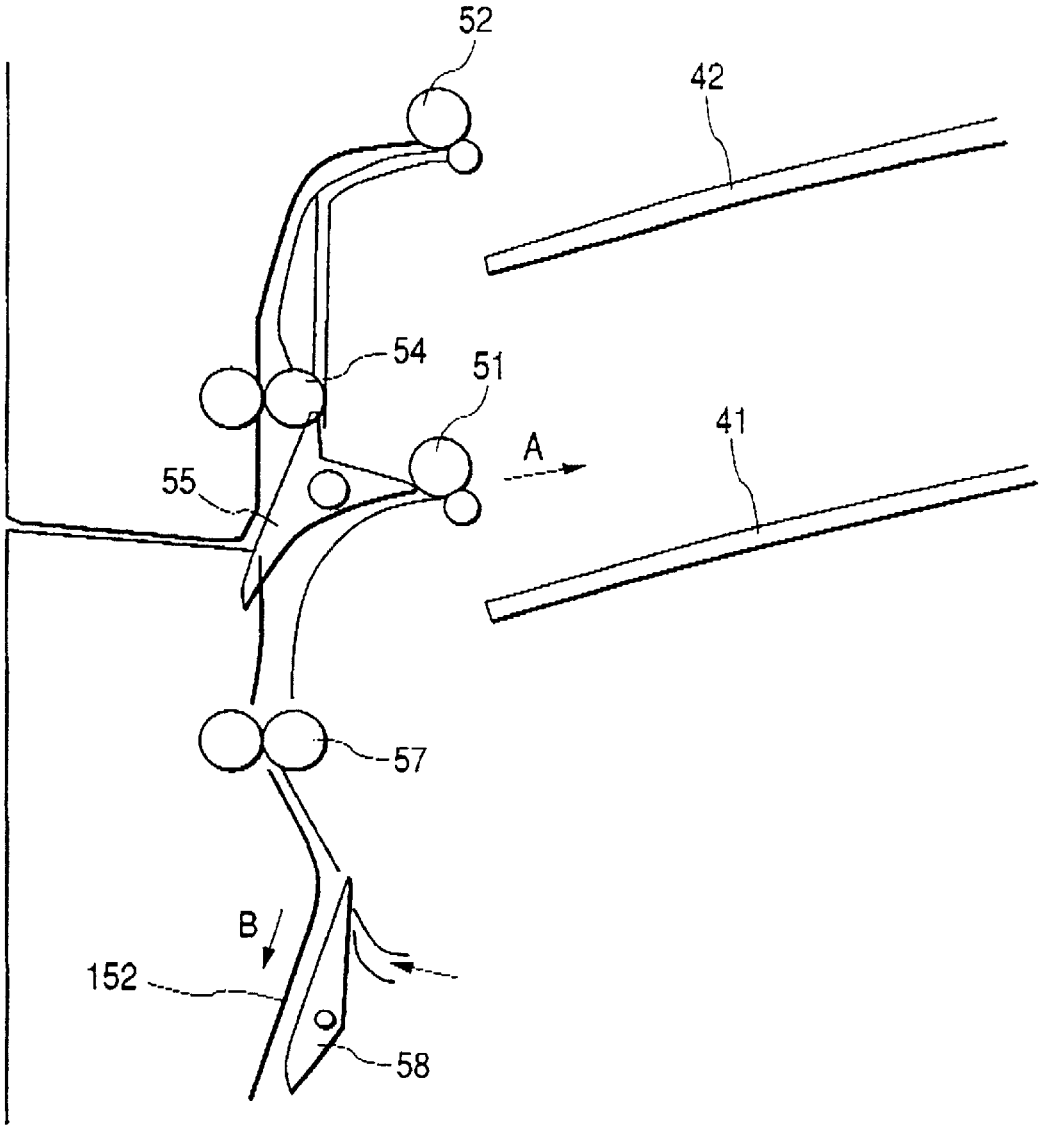
FIG. 17 Prior Art
FIG. 17 is a diagram showing a construction of the sheet discharging portion of the conventional image forming apparatus.
Figure 18:
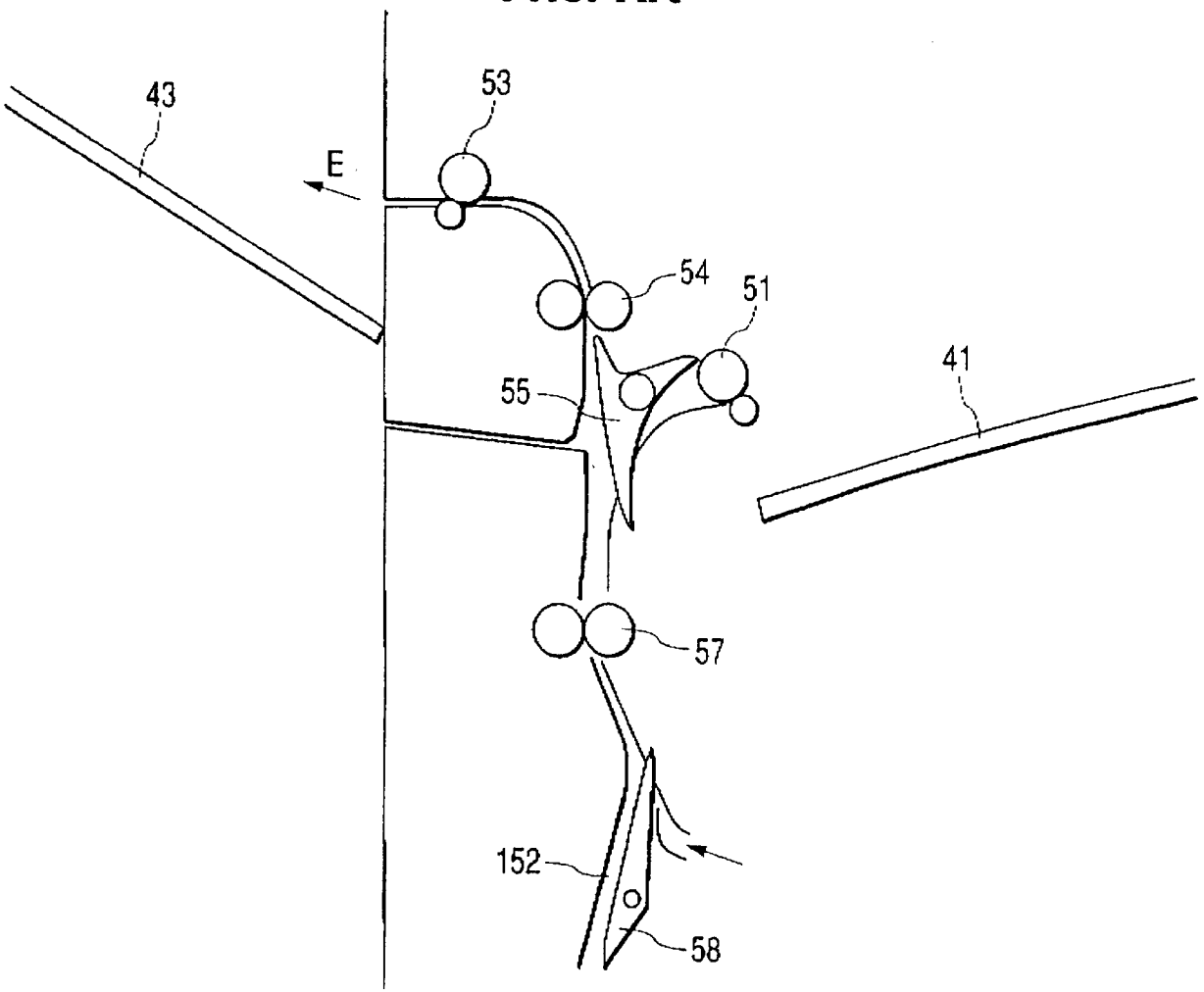
FIG. 18 Prior Art
FIG. 18 is a diagram showing another construction of the sheet discharging portion of the conventional image forming apparatus.

While in the above description the third sheet discharging tray 43 for sorting out is provided on the apparatus main body 101 as the second discharging portion, this should not be construed restrictively. Instead of the third sheet discharging tray 43, for example, it is also possible to attach as the second discharging portion a post-processing device 48 which performs a post-processing such as binding on sheets which have undergone image formation as shown in FIG. 14.

As described above, according to the present invention, when discharging sheets onto the second discharging means by a sheet discharging direction control means, sheets with images formed thereon are conveyed toward the first sheet conveyance route and then the first discharging means is reversed to convey the sheets toward the second sheet conveyance route, whereby it is possible to discharge the sheets without having to provide a sheet reversing path anew or involving any change in page order.

What is claimed is:

1. An image forming apparatus, comprising:

a main body;

an image forming portion for forming an image on a sheet;

first discharging means capable of normal and reverse rotation and adapted to discharge the sheet with the image formed thereon to a first discharging portion provided on one side of said main body;

second discharging means adapted to discharge the sheet with the image formed thereon to a second discharging portion provided on the other side of said main body;

a first sheet conveyance route for conveying the sheet with the image formed thereon toward said first discharging means;

a second sheet conveyance route for conveying the sheet with the image formed thereon toward said second discharging means; and wherein sheet discharging direction control means for, when discharging the sheet to said second discharging portion, causing the sheet with the image formed thereon to be conveyed toward said first sheet conveyance route, and then reversing said first discharging means to convey the sheet toward said second sheet conveyance route, wherein said sheet discharging direction control means causes a conveyance speed in said first sheet conveyance route to be increased after the image is formed.

2. An image forming apparatus according to claim 1, wherein said sheet discharging direction control means has conveyance route switching means which can be displaced to a first position for conveying the sheet with the image formed thereon toward said first sheet conveyance route and a second position for conveying the sheet conveyed by said first discharging means adapted to be reversed after conveying the sheet toward said first sheet conveyance route, toward said second sheet conveyance route.

3. An image forming apparatus according to claim 2, wherein said conveyance route switching means is held at the second position by a biasing member and adapted to be displaced to the first position by being pressed by the sheet.

4. An image forming apparatus according to any one of claims 1 through 3, wherein said first discharging portion is one of a plurality of discharging portions provided on one side of said main body.

5. An image forming apparatus according to claim 4, wherein a main body of said apparatus is provided with a sheet discharging space which is open sidewise, said plurality of discharging portions being provided in the sheet discharging space.

6. An image forming apparatus according to claim 5, wherein said second discharging portion is detachably provided on an outer side surface of said main body at a position opposite to the sheet discharging space.

7. An image forming apparatus according to claim 6, wherein said second discharging portion is a post-processing device for performing post-processing on sheets.

8. An image forming apparatus comprising:

an image forming portion which forms an image on a sheet;

a first stacking portion and a second stacking portion on which the sheet with the image formed thereon by said image forming portion is to be stacked;

a first conveyance path which guides the sheet with the image formed thereon by said image forming portion to said first stacking portion, with the image side facing downwards;

a conveyance rotary member which conveys the sheet in said first conveyance path; and a second conveyance path which, in said first conveyance path, switches back the sheet being conveyed in the direction of said first stacking portion with the image side facing downwards by reversing said conveyance rotary member and which guides the switched back sheet to said second stacking portion with the image side facing downwards, wherein a conveyance speed in said first sheet conveyance path is increased after the image is formed.

9. An image forming apparatus according to claim 8, further comprising a guide member which guides the sheet in said first conveyance path toward said conveyance rotary member and guides the sheet switched back by reversing said conveyance rotary member to said second conveyance path.

10. An image forming apparatus according to claim 8, wherein said first stacking portion is arranged above said image forming portion.

11. An image forming apparatus according to claim 10, further comprising an image reading portion provided above said image forming portion and adapted to read the image of an original, said first stacking portion being arranged between said image forming portion and said image reading portion.

12. An image forming apparatus according to claim 10 or 11, wherein said second stacking portion is provided sidewise with respect to said main body.

13. An image forming apparatus according to claim 12, wherein the sheet entering said first stacking portion and the sheet entering said second stacking portion advance in opposite directions.

14. An image forming apparatus comprising:

an image forming portion for forming an image on a sheet;

an image reading portion arranged above said image forming portion and adapted to read the image of an original;

a first stacking portion which is arranged between said image forming portion and said image reading portion and on which the sheet with the image formed thereon by said image forming portion is to be stacked;

a second stacking portion which is arranged sidewise with respect to a main body and on which the sheet with the image formed thereon by said image forming portion is to be stacked;

a first conveyance path for guiding the sheet with the image formed thereon by said image forming portion to said first stacking portion;

a conveyance rotary member for conveying the sheet in said first conveyance path; and a second conveyance path which, in said first conveyance path, switches back the sheet being conveyed in the direction of said first stacking portion by reversing said conveyance rotary member and which guides the switched back sheet to said second stacking portion.

* * * * *

UNITED STATES PATENT AND TRADEMARK OFFICE

CERTIFICATE OF CORRECTION

PATENT NO. : 6,725,011 B2
DATED : April 20, 2004
INVENTOR(S) : Akihiro Sato

It is certified that error appears in the above-identified patent and that said Letters Patent is hereby corrected as shown below:

Column 4,
Line 55, “apparatus,” should read -- apparatus. --.

Signed and Sealed this

Tenth Day of August, 2004

JON W. DUDAS
*Acting Director of the United States Patent and Trademark Office*